US011098488B2

(12) United States Patent
Toyoda

(10) Patent No.: US 11,098,488 B2
(45) Date of Patent: Aug. 24, 2021

(54) REBAR SPACER

(71) Applicant: TOYODA ARCHITECTS OFFICE, Ibaraki (JP)

(72) Inventor: Yoichi Toyoda, Ibaraki (JP)

(73) Assignee: TOYODA ARCHITECTS OFFICE, Ibaraki (JP)

( * ) Notice: Subject to any disclaimer, the term of this patent is extended or adjusted under 35 U.S.C. 154(b) by 0 days.

(21) Appl. No.: 16/650,384

(22) PCT Filed: Sep. 28, 2017

(86) PCT No.: PCT/JP2017/035107
§ 371 (c)(1),
(2) Date: Mar. 25, 2020

(87) PCT Pub. No.: WO2019/064404
PCT Pub. Date: Apr. 4, 2019

(65) Prior Publication Data
US 2020/0224418 A1 Jul. 16, 2020

(51) Int. Cl.
*E04C 5/18* (2006.01)
*E04C 5/20* (2006.01)
(Continued)

(52) U.S. Cl.
CPC ..... *E04C 5/18* (2013.01); *E04C 5/201* (2013.01); *E04B 2001/4192* (2013.01);
(Continued)

(58) Field of Classification Search
CPC . E04C 5/18; E04C 5/201; E04C 5/166; E04C 5/168; E04B 2001/4192; E04B 2013/02
(Continued)

(56) References Cited

U.S. PATENT DOCUMENTS 1,244,034 A * 10/1917 Cummings ..... E04B 1/4142 52/706
2,420,860 A * 5/1947 Burner ..... E04C 5/18 52/686
(Continued)

FOREIGN PATENT DOCUMENTS

JP S62-160026 U 10/1987
JP H3-11756 U 2/1991
(Continued)

OTHER PUBLICATIONS

International Search Report in PCT/JP2017/035107, dated Nov. 21, 2017. 5pp.

*Primary Examiner* — Paola Agudelo
(74) *Attorney, Agent, or Firm* — Hauptman Ham, LLP

(57) ABSTRACT

A rebar spacer installed in a rebar crossing portion includes a spacer body and a pair of installation metal fittings. The spacer body includes a main portion and a pair of leg portions integrally formed with the main portion. The pair of leg portions is protrudingly provided with an interval on a rebar-side surface of the main portion. The interval between the pair of leg portions is equal to or larger than a diameter of the rebar and a depth of the pair of leg portions in an installation direction is equal to or less than the diameter of the rebar. Each one of the pair of installation metal fittings has a structure such that one end portion is locked into one of the pair of leg portions and the other end portion is hooked on a back-side rebar.

13 Claims, 5 Drawing Sheets

(51) Int. Cl.
*E04B 1/41* (2006.01)
*E04C 5/16* (2006.01)

(52) U.S. Cl.
CPC ..... *E04B 2103/02* (2013.01); *E04C 5/166* (2013.01); *E04C 5/168* (2013.01)

(58) Field of Classification Search
USPC ..... 52/677
See application file for complete search history.

(56) References Cited

U.S. PATENT DOCUMENTS 3,289,378 A * 12/1966 Carroll ..... E04C 5/18 52/688
3,460,309 A * 8/1969 Ernst ..... E04C 5/20 52/677
4,073,114 A * 2/1978 Irish ..... E04B 1/4107 52/223.13
4,741,143 A * 5/1988 Foster, Jr. ..... E04C 5/201 405/239
4,866,903 A * 9/1989 Ferstay ..... E02D 5/74 52/677
5,269,113 A * 12/1993 Dreizler ..... B28B 21/56 52/649.1
6,061,990 A * 5/2000 McMahon ..... E04G 15/061 52/677
2003/0024204 A1* 2/2003 Swenson ..... E04C 5/167 52/677
2006/0153635 A1* 7/2006 Underwood ..... E04C 5/163 403/329
2010/0050559 A1* 3/2010 Tillery ..... E04C 5/20 52/677
2010/0281814 A1* 11/2010 Ripley ..... E04C 5/168 52/677
2014/0352250 A1* 12/2014 Karabas ..... E04C 5/18 52/712
2016/0153192 A1* 6/2016 Smith ..... E04C 5/167 52/649.8
2017/0254085 A1* 9/2017 Larkin ..... E04C 5/18

FOREIGN PATENT DOCUMENTS

JP H7-44539 U 11/1995
JP 2012-237140 A 12/2012
JP 2013-155571 A 8/2013
JP 2014-234600 A 12/2014
JP 2015-175194 A 10/2015
JP 2016-44527 A 4/2016

* cited by examiner

REBAR SPACER

RELATED APPLICATIONS

The present application is a National Phase of International Application Number PCT/JP2017/035107, filed Sep. 28, 2017.

TECHNICAL FIELD

The present invention relates to a rebar spacer used in order to ensure the distance (covering depth) from the rebar surface to the concrete surface in a rebar concrete structure. More specifically, the present invention relates to a rebar spacer installed on a rebar in order to hold the distance between the rebar and a form when constructing a rebar concrete structure.

BACKGROUND ART

In a rebar concrete structure in the civil engineering/construction field, it is specified by laws or the like that the covering depth of the concrete to the rebar is set to a predetermined value or more in order to secure structural resistance, durability, and fire resistance. Therefore, in general, when constructing the rebar concrete structure, the covering depth is ensured by installing a spacer on assembled rebars, and then placing concrete in a state where the distance between the rebar surface and a form is held at a predetermined length.

At present, as sold or proposed spacer for rebar concrete structures, those containing plastic, concrete, mortar, metal, or a combination thereof are mentioned and are different from each other in shapes and installation methods (see Patent Documents 1 to 5. For example, in the case of the plastic spacer, those having a complicated shape provided with a leg portion or an arm portion described in Patent Document 2 are mentioned besides those having a disk shape in which a central portion is opened described in Patent Document 1.

Meanwhile, Patent Document 3 describes a stainless steel spacer having a structure in which a truncated cone-shaped cone provided with a through-hole with a female screw and two types of bolts of a fixing bolt and a press bolt are combined. Moreover, as the concrete or mortar spacers, one having a structure in which a wire rod for installation is buried in a spacer main portion having a substantially fan shape in a side surface view described in Patent Document 4 and one having a structure in which a fixing portion containing cruciform crossing rebars is welded and fixed to a body portion in which the rebar tip is embedded in a block-shaped mortar portion described in Patent Document 5 are mentioned, for example.

CITATION LIST

Patent Document

[Paten Document 1] JP-A No. 2012-237140
[Paten Document 2] JP-A No. 2015-175194
[Paten Document 3] JP-A No. 2016-44527
[Paten Document 4] JP-A No. 2013-155571
[Paten Document 5] JP-A No. 2014-234600

SUMMARY OF THE INVENTION

Technical Problem

However, the conventional rebar spacers described above have problems in terms of workability, long-term durability of a structure, stable ensuring of minimum covering, and the like. Specifically, the plastic spacers described in Patent Documents 1 and 2 are inexpensive and lightweight but have poor adhesiveness with concrete and also have a coefficient of thermal expansion greatly different from that of concrete. Therefore, from a long-term view, there is a risk that a crack occurs in concrete, so that rust is generated in the rebar or the strength of a structure decreases.

Although the metal spacer described in Patent Document 3 is excellent in adhesiveness with concrete and strength, the installation property to a rebar is poor and the working efficiency is poor because there is a necessity of removing a component after placing concrete, and then filling the hole with mortar. In some metal rebar spacers, the component is kept attached thereto. However, in that case, a metal component is exposed to the structure surface, which poses an appearance problem and, in addition thereto, there is a possibility that rust is generated from a spacer component, so that corrosion reaches an internal rebar.

Meanwhile, the concrete or mortar spacers described in Patent Documents 4 and 5 have good adhesiveness with concrete and are excellent also in strength but have problems that installation work to a rebar is complicated and rotation, omission, and the like are likely to occur also after installed on a rebar. Furthermore, the concrete or mortar spacers require a member for installation for fixing the spacers to a rebar. Depending on the type thereof, the thickness of a rebar on which the spacer can be installed and the position where the spacer can be installed are limited, and thus a plurality of separators different in the size of an installation member needs to be prepared according to the thickness of a rebar and the installation position.

Thus, it is an object of the present invention to provide a rebar spacer which is easy to install on a rebar, which can stably maintain a distance with a form after installed on the rebar, and which can ensure minimum covering even when installed on either a horizontal bar or a vertical bar.

Solution to Problem

A rebar spacer according to the present invention is a rebar spacer installed in a rebar crossing portion when constructing a rebar concrete structure and is provided with a spacer body containing concrete or mortar and a pair of installation metal fittings containing a spring material and fixing the spacer body to the rebar, in which the spacer body is provided with a main portion ensuring a covering depth by abutting on a front-side rebar as viewed from the spacer body and a form and a pair of leg portions each protrudingly provided with an interval on the rebar-side surface of the main portion, the main portion and the pair of leg portions are integrally formed, the interval is equal to or larger than the diameter of the front-side rebar and the length is equal to or less than the diameter of the front-side rebar in the pair of leg portions, and one end portion in each of the pair of installation metal fittings is locked into one of the pair of leg portions and the other end portion is hooked on a back-side rebar as viewed from the spacer body.

In the rebar spacer of the present invention, a groove is formed in each of the pair of leg portions and the one end portion of each of the pair of installation metal fittings may be engaged with the groove.

In the rebar spacer of the present invention, a locking hole is formed in each of the pair of leg portions and the one end portion of each of the pair of installation metal fittings may be inserted into the locking holes.

The pair of installation metal fittings may be detachable/attachable.

The pair of installation metal fittings can be formed of steel, for example.

In the rebar spacer of the present invention, when installed on the rebar, the front-side rebar is located between the pair of leg portions to abut on the main portion of the spacer body, for example.

Advantageous Effects of Invention

According to the present invention, easy installation on a rebar can be achieved, omission/displacement/rotation and the like are hard to occur after installed on a rebar, a common use in a horizontal bar and a vertical bar can be achieved, and minimum covering can be certainly ensured irrespective of the installation position.

BRIEF DESCRIPTION OF DRAWINGS

FIGS. 3A and 3B are perspective views illustrating a state where the rebar spacer 10 illustrated in FIG. 1 is installed on a horizontal bar, in which FIG. 3A is a figure viewed from the front and FIG. 3B is a figure viewed from the back.

DESCRIPTION OF EMBODIMENTS

Hereinafter, embodiments for carrying out the present invention are described in detail with reference to the attached drawings. The present invention is not limited to the embodiments described below.

First Embodiment

Figure 1:
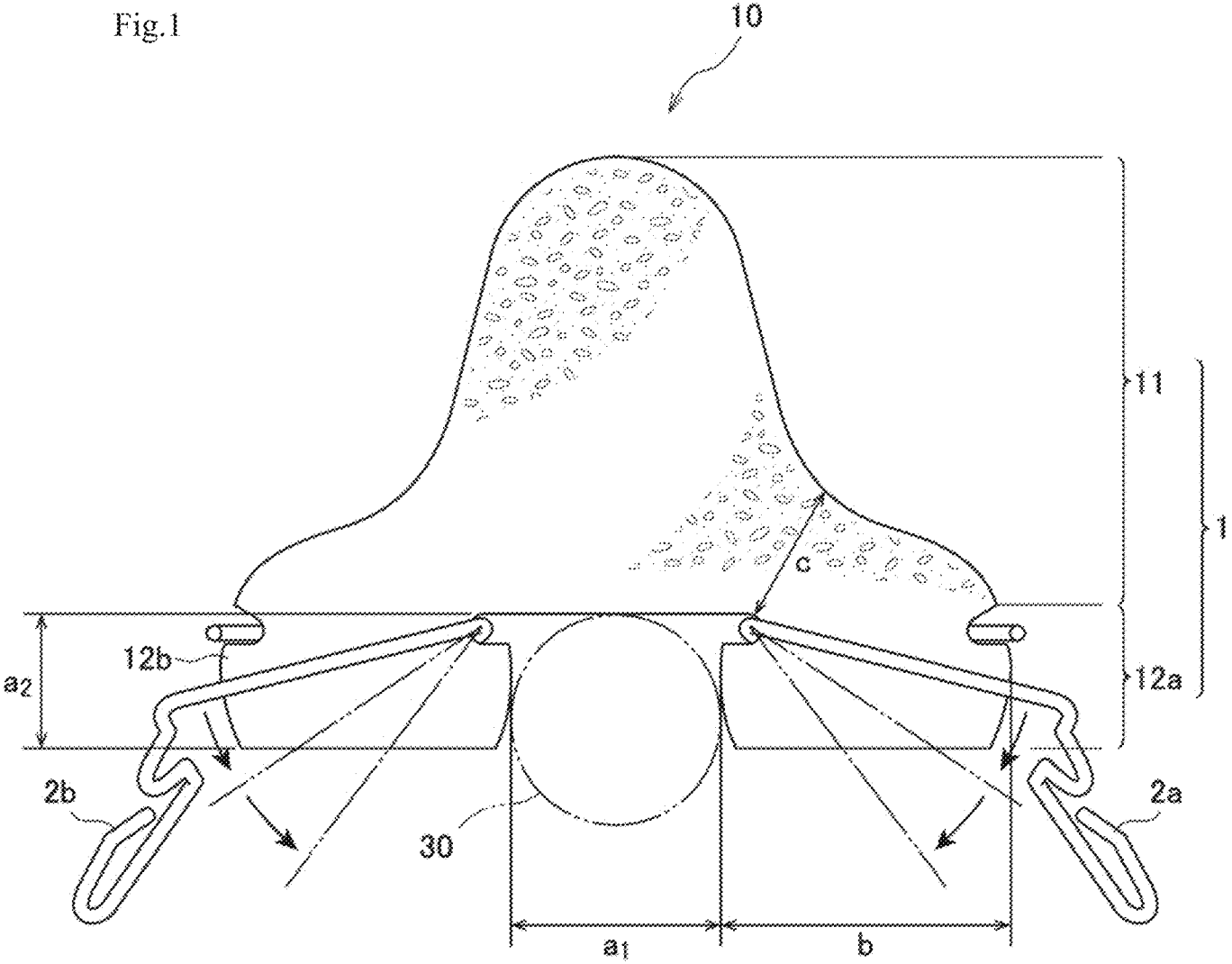
FIG. 1 is a plan view illustrating a configuration example of a rebar spacer of a first embodiment of the present invention.
Figure 2:
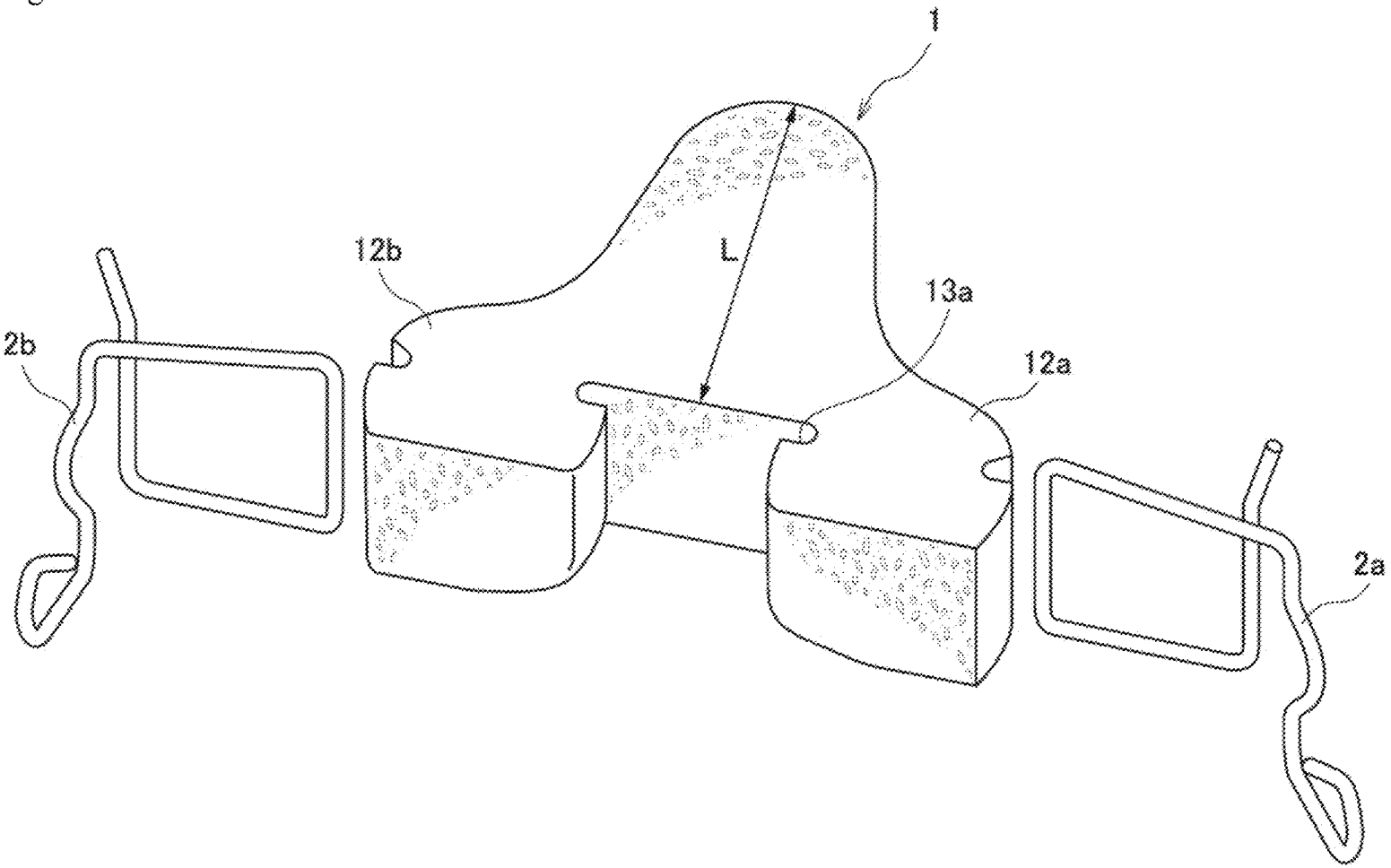
FIG. 2 is an exploded perspective view of a rebar spacer 10 illustrated in FIG. 1.

First, a rebar spacer according to a first embodiment of the present invention is described. FIG. 1 is a plan view illustrating a configuration example of the rebar spacer of this embodiment. FIG. 2 is an exploded perspective view of a rebar spacer 10 illustrated in FIG. 1. As illustrated in FIG. 1 and FIG. 2, the rebar spacer 10 of this embodiment contains two members of a spacer body 1 and a pair of installation metal fittings 2*a* and 2*b* for fixing the spacer body 1 to a rebar.

[Spacer Body 1]

The spacer body 1 is disposed between the rebar and a form and maintains an interval therebetween so that the distance between the rebar and the form is not shorter than a predetermined value in concrete placing and is configured by a main portion 11 and a pair of leg portions 12*a* and 12*b* protrudingly provided on the bottom surface of the main portion 11 as illustrated in FIG. 1 and FIG. 2. The main portion 11 and the leg portions 12*a* and 12*b* are integrally formed using concrete or mortar.

The main portion 11 of the spacer body 1 ensures covering depth by abutting on the form and rebars 3 and 4 located on the front side as viewed from the rebar spacer 10. The distance from a portion abutting on the frame to a portion abutting on the rebar 30 has the same length as a required covering depth L. The main portion 11 may be shaped to stably abut on the form and the front-side rebar 30 and not to block the flow of concrete and can take shapes, such as a prism shape, a truncated pyramid shape, a cylindrical shape, and a truncated cone shape, for example, besides a flat plate shape of a substantially trapezoid shape in a plan view as illustrated in FIGS. 1 and 2.

Since the shape of the main portion 11 of the spacer body 1 is harder to leave marks when released from a mold as the area in which the main portion 11 contacts the form is smaller, the shape is advantageous on appearance. However, when the area in which the main portion 11 contacts the form is excessively small, the main portion 11 of the spacer body 1 is sunk into the form, for example, to cause a construction or appearance problem. Therefore, a shape with a sharp tip is unsuitable for the main portion 11.

The pair of leg portions 12*a* and 12*b* is used for attaching the installation metal fittings 2*a* and 2*b*. An interval $a_1$ is equal to or larger than the diameter of the front-side rebar 30 and a length $a_2$ is equal to or less than the diameter of the front-side rebar 30. When installing the rebar spacer 10 of this embodiment on the rebar, the front-side rebar 30 is disposed between the leg portion 12*a* and the leg portion 12*b*. However, when the interval $a_1$ between the leg portion 12*a* and the leg portion 12*b* is shorter than the diameter of the front-side rebar 30, the front-side rebar 30 cannot be caused to abut on the main portion 1, so that the covering depth is larger than a designed value.

On the other hand, when the interval $a_1$ between the leg portion 12*a* and the leg portion 12*b* is excessively larger than the diameter of the front-side rebar 30, there is a risk that the attitude stability after installed on the rebar decreases. Thus, the interval $a_1$ between the leg portion 12*a* and the leg portion 12*b* is preferably equal to or a little larger than the diameter of the front-side rebar 30. For example, when the interval $a_1$ between the leg portion 12*a* and the leg portion 12*b* is set to 19 mm, the rebar spacer 10 is also applicable to not only a case where the diameter of the rebar is 19 mm but a case where the diameter of the rebar is 13 mm or 16 mm.

When the length $a_2$ between the pair of leg portions 12*a* and 12*b* exceeds the diameter of the front-side rebar 30, the leg portions 12*a* and 12*b* hit the rebar located on the back side as viewed from the rebar spacer 10, so that a gap is formed between the front-side rebar 30 and the main portion 11, and thus the covering depth becomes larger than the designed value. Thus, the length $a_2$ between the leg portions 12*a* and 12*b* is set to be equal to or less than the diameter of the front-side rebar 30.

In each of the leg portions 12*a* and 12*b*, a locking groove 13*a* for locking the installation metal fittings 2*a* and 2*b* may be formed in at least one part thereof. Due to a configuration of locking the installation metal fittings 2*a* and 2*b* into not the main portion 11 but the leg portions 12*a* and 12*b* integrally formed with the main portion 11, it can be prevented that the installation metal fittings 2*a* and 2*b* are protruded to the rebar side to degrade a covering value.

The locking groove 13*a* provided in each of the leg portions 12*a* and 12*b* may be formed at an angle and with a width such that, when the installation metal fittings 2*a* and 2*b* are engaged, the installation metal fittings 2*a* and 2*b* are not shifted or removed, for example. However, when the locking grooves 13*a* are formed in the surface (inside surface) where the rebar 30 located on the front side is disposed, the width and the depth are desirably set so that the installation metal fittings 2*a* and 2*b* are entirely housed in the grooves so as not to affect the covering depth due to the contact of the installation metal fittings 2*a* and 2*b* with the rebar 30.

A width b of each of the leg portions 12*a* and 12*b* and a minimum width c of the main portion 11 in the spacer body 1 are not particularly limited. The spacer body 1 may have widths such that strength enough to withstand force applied when the installation metal fittings 2*a* and 2*b* are hooked on the rebar is obtained.

[Installation Metal Fittings 2*a* and 2*b*]

The installation metal fittings 2*a* and 2*b* contain a spring material, such as a wire formed spring or a plate spring. One ends are locked into the leg portions 12*a* and 12*b* of the spacer body 1 and the other ends can be hooked on the rebar located on the back side as viewed from the rebar spacer 10. When the spring material, such as a wire formed spring or a plate spring, is used for the installation metal fittings 2*a* and 2*b*, the spacer main portion 11 is pressed against the front-side rebar 30 by the restoring force (elastic force) of the installation metal fittings 2*a* and 2*b* when installed on the rebar, and therefore the stability is improved.

The shape of the installation metal fittings 2*a* and 2*b* is not particularly limited. The one ends may have a shape such that the one ends can be locked into the leg portions 12*a* and 12*b*. The other ends may have a shape such that the other ends can be hooked on the back-side rebar. From the viewpoint of workability, the other end portions preferably have a shape such that the other end portions can be picked by a hand. Materials of the installation metal fittings 2*a* and 2*b* preferably are formed of steel as with the rebar from the viewpoint of compatibility with concrete.

When the installation metal fittings 2*a* and 2*b* are wound around the leg portions 12*a* and 12*b*, respectively, to be locked thereinto as illustrated in FIG. 1, it is preferable that the installation metal fittings 2*a* and 2*b* do not enter between the main portion 11 of the spacer body 1 determining the covering depth L and the rebar by providing the locking groove 13*a* in each of the leg portions 12*a* and 12*b* and engaging the installation metal fittings 2*a* and 2*b* with the locking grooves 13*a*.

The installation metal fittings 2*a* and 2*b* are simply locked into the spacer body 1 and are not caused to adhere thereto by embedding or the like. Therefore, a plurality of types of installation metal fittings is manufactured and can be used in combination according to a required covering depth and the type or the thickness of the rebar. In that case, the management in manufacturing and construction is facilitated by indicating a numerical value of the covering depth on the spacer body 1 and classifying the installation metal fittings 2*a* and 2*b* by color based on the size.

[Manufacturing Method]

Next, a method for manufacturing the rebar spacer 10 of this embodiment is described. With respect to the rebar spacer of this embodiment, the spacer body 1 and the installation metal fittings 2*a* and 2*b* are separately produced, and then the installation metal fittings 2*a* and 2*b* corresponding to the thickness of the rebar in an installation portion are attached to the spacer body 1 having a target covering depth L according to the design specification.

The method for manufacturing the spacer body 1 is not particularly limited. The spacer body 1 can be manufactured by known methods, such as a "pressing method" and a "casting method". However, from the viewpoint of an improvement of productivity, the "pressing method" including charging materials into a die, and then performing compression molding at high pressure is preferably used. Conventionally, the "casting method" requiring long-time curing has been mainly used. In the rebar spacer of this embodiment, however, the installation metal fittings 2*a* and 2*b* are separately provided, and therefore the "pressing method" in which the curing time is short is applicable. Thus, the rebar spacer 10 of this embodiment is superior to conventional spacers also from the point of a manufacturing process.

Meanwhile, a method for manufacturing the installation metal fittings 2*a* and 2*b* is also not particularly limited. When the installation metal fittings 2*a* and 2*b* are configured by a wire formed spring, for example, the installation metal fittings 2*a* and 2*b* can be processed into an arbitrary shape using a wire forming machine or the like. Then, the installation metal fittings 2*a* and 2*b* processed into a predetermined shape are locked into the leg portions 12*a* and 12*b* of the spacer body 1, whereby the rebar spacer of this embodiment is obtained.

[Usage]

Figure 3A:
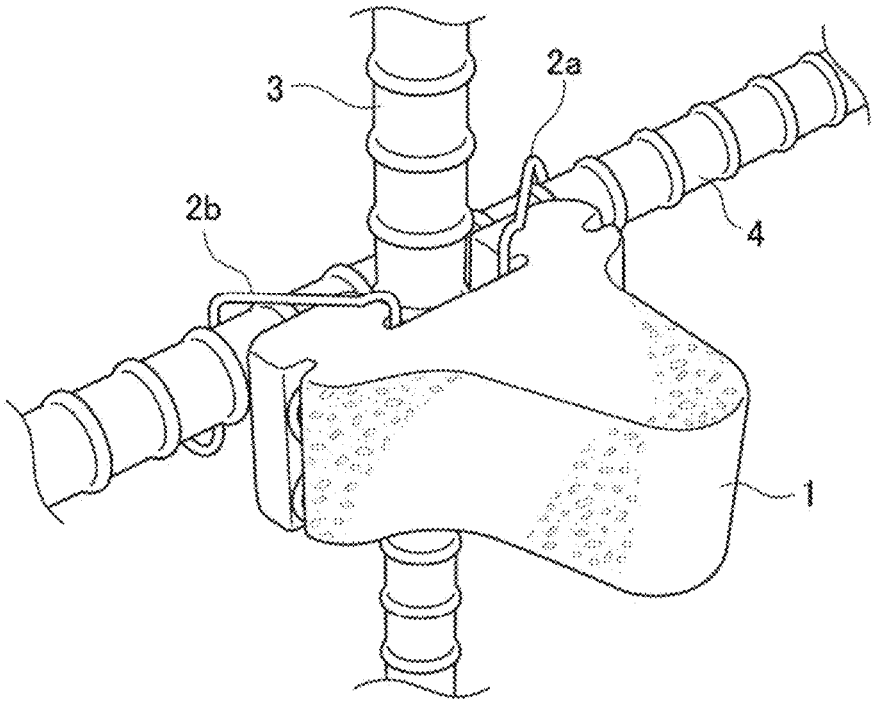
Figure 3B:
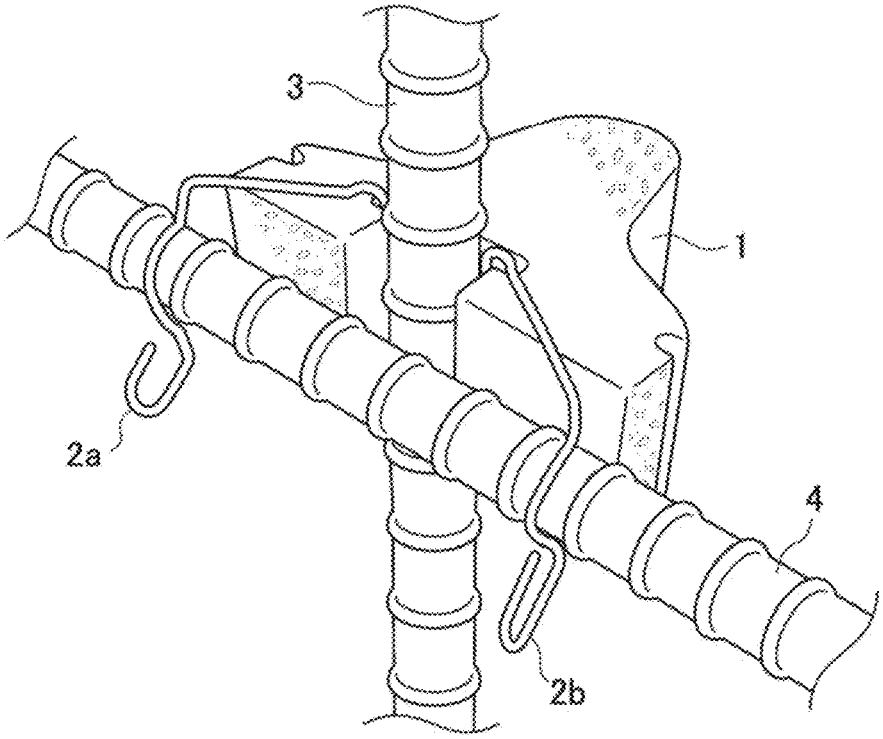
Figure 4:
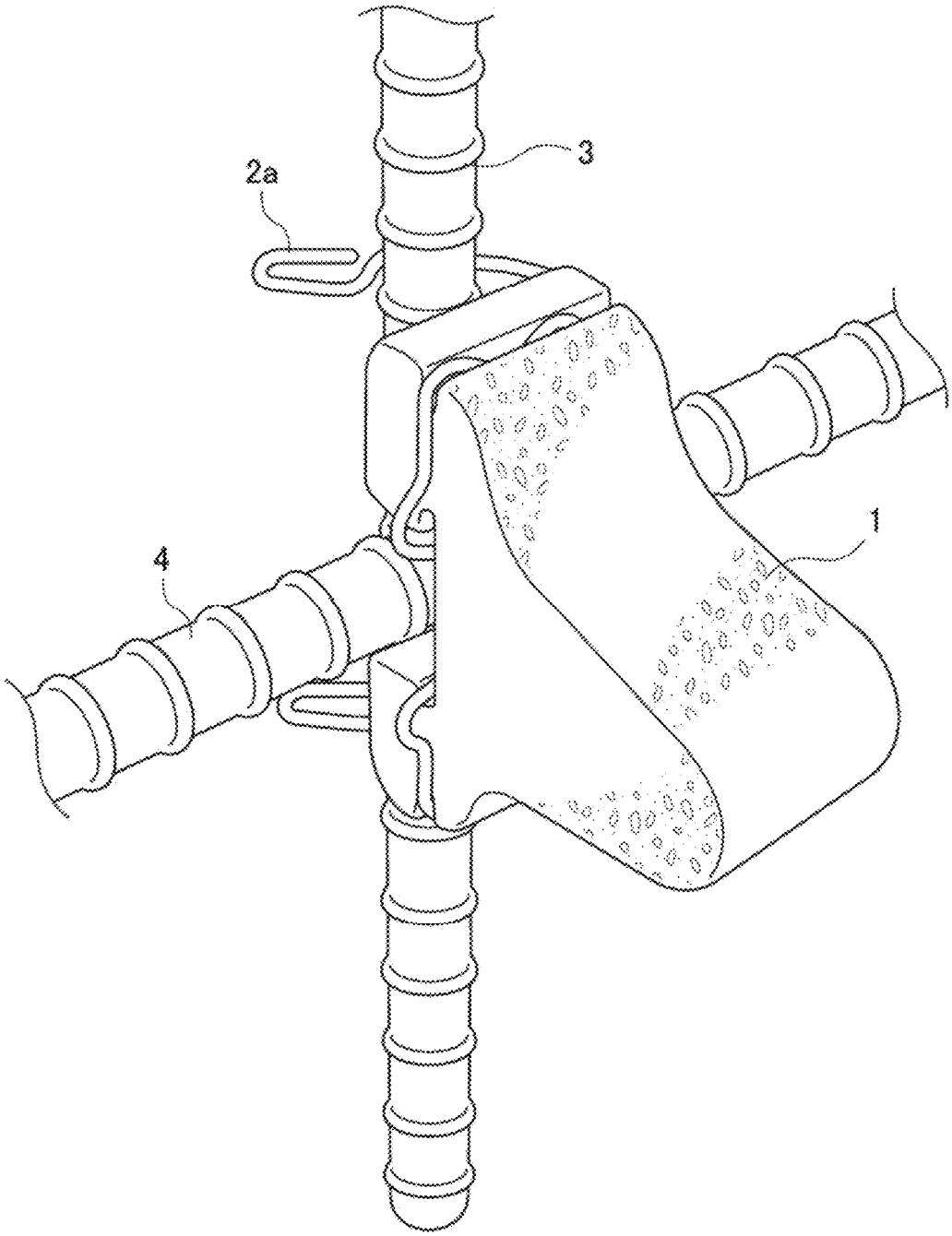
FIG. 4 is a perspective view illustrating a state where the rebar spacer 10 illustrated in FIG. 1 is installed on a vertical bar.

Next, the usage of the rebar spacer 10 of this embodiment, i.e., a method for installing the rebar spacer 10 on a rebar, is described. FIGS. 3A and 3B are perspective views illustrating a state where the rebar spacer 10 of this embodiment is installed on a horizontal bar. FIG. 3A is a figure viewed from the front. FIG. 3B is a figure viewed from the back. FIG. 4 is a perspective view illustrating a state where the rebar spacer 10 of this embodiment is installed on a vertical bar.

The rebar spacer 10 of this embodiment is installed in a portion where the horizontal bar and the vertical bar cross each other. As illustrated in FIGS. 3A and 3B, when the vertical bar 3 is located on the front side and the horizontal bar 4 is located on the back side, the rebar spacer 10 is disposed so that the vertical bar 4 is located between the leg portion 12*a* and the leg portion 12*b* of the spacer body 1, and then the installation metal fittings 2*a* and 2*b* are hooked on the horizontal bar 4.

A method for hooking the installation metal fittings 2*a* and 2*b* on the horizontal bar 4 is not particularly limited. For example, the spacer body 1 is disposed above the crossing portion of the vertical bar 3 and the horizontal bar 4, and then the installation metal fittings 2*a* and 2*b* are pressed by a hand so that a gap is formed between the spacer body 1 and the horizontal bar 4. Then, the spacer body 1 is moved below in the state, the hand is released when the spacer body 1 reaches the crossing portion of the rebars, and then the installation metal fittings 2*a* and 2*b* are hooked on the horizontal bar 4.

Meanwhile, as illustrated in FIG. 4, when the horizontal bar 4 is located on the front side and the vertical bar 3 is located on the back side, the direction of the rebar spacer 10 is changed, the spacer body 1 is disposed so that the horizontal bar 4 is located between the leg portion 12*a* and the leg portion 12*b*, and then the installation metal fittings 2*a* and 2*b* are hooked on the vertical bar 3. By this operation, the main portion 11 of the spacer body 1 is pressed against the rebar (vertical bar 3 or horizontal bar 4) on the front side by the restoring force (elastic force) of the installation metal fittings 2*a* and 2*b* having spring characteristics, so that the rebar spacer 10 of this embodiment is fixed to the rebar.

In the rebar spacer 10 installed by the method described above, the rebar (vertical bar 3 or horizontal bar 4) on the front side is located between the leg portion 12*a* and the leg portion 12*b*, and therefore the spacer body 1 can be prevented from rotating in the forward and backward or right and left direction after installed. When the rebar spacer 10 of this embodiment is used, the installation metal fittings 2*a* and 2*b* are not present between the rebar surface and the form and only the main portion 11 of the spacer body 1 is present. Therefore, a structure is obtained in which only concrete or mortar is present in the "cover" protecting the rebar from rust. More specifically, by the use of the rebar spacer 10 of this embodiment, a minimum covering depth indicated in the structural guideline can be realized.

In the rebar spacer 10 of this embodiment, the installation metal fittings 2*a* and 2*b* are simply locked into the leg portions 12*a* and 12*b* of the spacer body 1. Therefore, when the size of the installation metal fittings 2*a* and 2*b* does not fit the rebar in the installed portion, the installation metal fittings 2*a* and 2*b* can be removed and exchanged on the spot. Thus, by making the installation metal fittings 2*a* and 2*b* attachable/detachable, not only the manufacturing efficiency but the workability at a site is improved.

As described above in detail, in the rebar spacer of this embodiment, the installation metal fitting is attached to each of two rebar abutment portions and the installation metal fittings are not present between the main portion of the spacer body determining the covering depth and the rebar located on the front side. Therefore, the minimum covering can be easily and certainly ensured. Moreover, the rebar spacer of this embodiment can be installed on both a vertical bar and a horizontal bar by simply changing the direction of the spacer body, and therefore can also be installed on both sides (both the inner side and the outside) of the rebar crossing portion.

In the rebar spacer of this embodiment, the installation metal fittings have spring characteristics and are fixed to the rebar using the elastic force thereof. Therefore, even when the thickness of the rebar on which the rebar spacer can be installed varies and required covering depth is the same and the rebar size in the installation portion is different, the same rebar spacer can be used. Moreover, in the rebar spacer of this embodiment, the installation metal fittings are not buried in the spacer body and are separately provided so as to be detachable/attachable. Therefore, simply by manufacturing several types of spacer bodies different in the corresponding covering depth and several types of installation metal fittings different in thickness of a rebar on which the spacer can be installed, various demands can be dealt with. As a result, the rebar spacer of this embodiment is excellent in productivity and is easily managed as compared with a conventional rebar spacer.

The rebar spacer of this embodiment can be certainly installed on a rebar and is free from a fear of omission or rotation by an easy operation of disposing the rebar spacer so that the front-side rebar is located between the pair of leg portions provided in the spacer body, and then hooking the installation metal fittings on the back-side rebar, and therefore the working efficiency is remarkably improved as compared with conventional spacers. Moreover, the rebar spacer of this embodiment is not limited in an installation place, and therefore is applicable also to a pillar, a floor, and the like. Furthermore, in the rebar spacer of this embodiment, the spacer body is formed of concrete or mortar having good compatibility with concrete and high strength and does not contain plastic. Therefore, even when buried in placed concrete, there is no risk of causing a strength reduction of a structure or corrosion of the rebar.

Modification of First Embodiment

Figure 5:
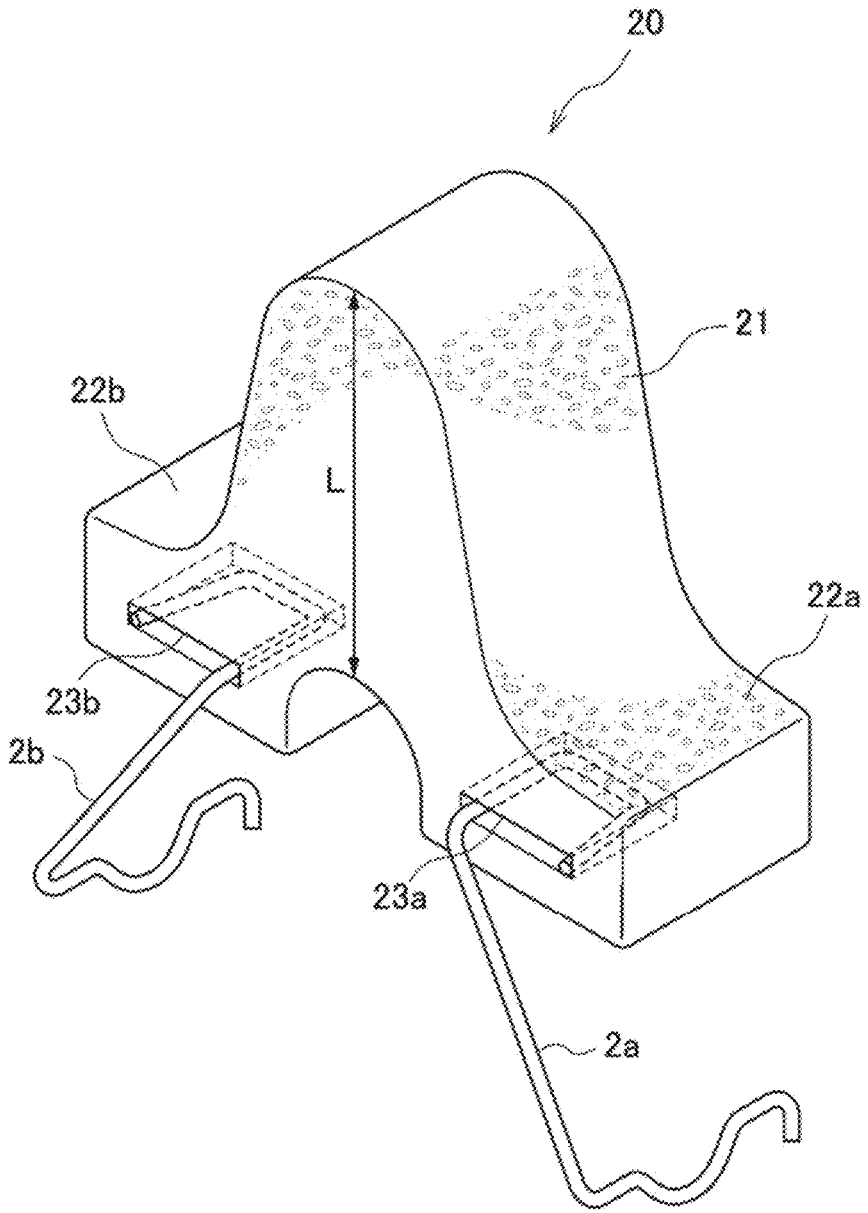
FIG. 5 is a perspective view illustrating a configuration example of a rebar spacer of a modification of the first embodiment of the present invention.

Next, a rebar spacer according to a modification of the first embodiment of the present invention is described. FIG. 5 is a perspective view illustrating a configuration example of the rebar spacer of this modification. In FIG. 5, the same reference numerals are given to the same constituent components as those of the rebar spacer 10 illustrated in FIG. 1 and a detailed description thereof is omitted.

As illustrated in FIG. 5, in a rebar spacer 20 of this modification, locking holes 23*a* and 23*b* for locking the installation metal fittings 2*a* and 2*b*, respectively, are formed in place of the grooves in the leg portions 22*a* and 22*b* of the spacer body. In the rebar spacer 20 of this modification, one end portions of the installation metal fittings 2*a* and 2*b* are inserted into the locking holes 23*a* and 23*b*, respectively, and thus the installation metal fittings 2*a* and 2*b* are locked into the leg portions 22*a* and 22*b*, respectively. Herein, the size of the stepwise locking holes 23*a* and 23*b* are not particularly limited and may be a size such that the one end portions of the installation metal fittings 2*a* and 2*b* can be inserted and further the inserted end portions expand within the holes, so that the position of the installation metal fittings 2*a* and 2*b* can be held by the elastic force thereof.

The rebar spacer 20 of this modification can also be easily and certainly installed on a rebar by disposing the spacer body so that a front-side rebar is located between the leg portion 22*a* and the leg portion 22*b*, and then hooking the other end portions of the installation metal fittings 2*a* and 2*b* on a back-side rebar in the same manner as in the rebar spacer 10 of the first embodiment described above. As a result, by utilizing the rebar spacer of this modification, the workability and the stability after installed on the rebar are improved and, even when installed on either a horizontal bar or a vertical bar, the minimum covering can be ensured.

The configurations and the effects other than the above in the rebar spacer of this modification are the same as those of the first embodiment described above.

REFERENCE SIGNS LIST

1: spacer body
2*a*. 2*b*: installation metal fittings
3: vertical bar
4: horizontal bar
10, 20: rebar spacer
11, 21: main portion
12*a*, 12*b*. 22*a*, 22*b*: leg portion
13*a*, 13*b*: locking groove
23*a*, 23*b*: locking hole
30: front-side rebar
L: covering depth

The invention claimed is:

1. A rebar spacer, the rebar spacer comprising:

a spacer body containing concrete or mortar; and a pair of installation metal fittings containing a spring material and fixing the spacer body to rebars, wherein the spacer body is provided with a main portion ensuring a covering depth by abutting on a front-side rebar as viewed from the spacer body and a form and a pair of leg portions each protrudingly provided with a gap between leg portions of the pair of leg portions on a rebar-side surface of the main portion, the main portion and the pair of leg portions are integrally formed, in the pair of leg portions, the gap between the leg portions is equal to or larger than a diameter of the front-side rebar and a length is equal to or less than the diameter of the front-side rebar, and a groove is formed in each of the pair of leg portions, in each of the pair of installation metal fittings, one end portion is locked into one of the pair of leg portions and another end portion is hooked on a back-side rebar as viewed from the spacer body, the one end portion of each of the pair of installation metal fittings is engaged with the groove, the installation metal fittings are wound around the leg portions to be locked, and the rebar spacer is configured to be installed in a rebar crossing portion.

2. The rebar spacer according to claim 1, wherein the pair of installation metal fittings is detachable.

3. The rebar spacer according to claim 1, wherein the pair of installation metal fittings is formed of steel spring material.

4. The rebar spacer according to claim 3, wherein the pair of installation metal fittings is wire formed spring or plate spring.

5. The rebar spacer according to claim 1, wherein when installed on the rebars, the front-side rebar is located between the pair of leg portions to abut on the main portion of the spacer body.

6. A rebar spacer, the rebar spacer comprising:

a spacer body containing concrete or mortar; and a pair of installation metal fittings containing a spring material and configured to fix the spacer body to rebars, wherein the spacer body is provided with a main portion ensuring a covering depth when abutting on a front-side rebar as viewed from the spacer body and a form and a pair of leg portions each protrudingly provided with a gap between the leg portions on a rebar-side surface of the main portion, the main portion and the pair of leg portions are integrally formed, in the pair of leg portions, the gap between the leg portions is equal to or larger than a diameter of the front-side rebar and a length is equal to or less than the diameter of the front-side rebar, and a locking hole is formed in each of the pair of leg portions, in each of the pair of installation metal fittings, one end portion is configured to be inserted into the locking hole and another end portion is configured to be hooked on a back-side rebar as viewed from the spacer body, the one end portions of the installation metal fittings is configured to expand within the holes by elastic force, thereby holding a position of the one end portions of the installation metal fittings within the holes, and the rebar spacer is configured to be installed in a rebar crossing portion.

7. The rebar spacer according to claim 6, wherein the pair of installation metal fittings is formed of steel spring material.

8. The rebar spacer according to claim 7, wherein the pair of installation metal fittings is wire formed spring or plate spring.

9. The rebar spacer according to claim 6, wherein when installed on the rebars, the front-side rebar is located between the pair of leg portions to abut on the main portion of the spacer body.

10. The rebar spacer according to claim 6, wherein the pair of installation metal fittings is detachable.

11. The rebar spacer according to claim 6, wherein the one end portion is bent.

12. The rebar spacer according to claim 6, wherein the one end portion is substantially U-shaped.

13. A rebar spacer, the rebar spacer comprising:

a spacer body containing concrete or mortar; and a pair of installation metal fittings containing a spring material and configured to fix the spacer body to rebars, wherein the spacer body is provided with a main portion ensuring a covering depth when abutting on a front-side rebar as viewed from the spacer body and a form and a pair of leg portions each protrudingly provided with a gap between the leg portions on a rebar-side surface of the main portion, the main portion and the pair of leg portions are integrally formed, in the pair of leg portions, the gap between the leg portions is equal to or larger than a diameter of the front-side rebar and a length is equal to or less than the diameter of the front-side rebar, and a locking hole is formed in each of the pair of leg portions, in each of the pair of installation metal fittings, one end portion is substantially U-shaped and is configured to be inserted into the locking hole and another end portion is configured to be hooked on a back-side rebar as viewed from the spacer body, and the rebar spacer is configured to be installed in a rebar crossing portion.

* * * * *